US006845727B2

(12) United States Patent
Eide et al.

(10) Patent No.: US 6,845,727 B2
(45) Date of Patent: Jan. 25, 2005

(54) COOLING WATER SYSTEM

(75) Inventors: Jørgen Eide, Fana (NO); Pentti Paurola, Hafrsfjord (NO); Otto Skjåstad, Kolbjørnsvik (NO)

(73) Assignee: Statoil ASA, Stavanger (NO)

( * ) Notice: Subject to any disclaimer, the term of this patent is extended or adjusted under 35 U.S.C. 154(b) by 17 days.

(21) Appl. No.: 10/168,510

(22) PCT Filed: Dec. 22, 2000

(86) PCT No.: PCT/NO00/00447

§ 371 (c)(1),
(2), (4) Date: Oct. 24, 2002

(87) PCT Pub. No.: WO01/47768

PCT Pub. Date: Jul. 5, 2001

(65) Prior Publication Data

US 2003/0138299 A1 Jul. 24, 2003

(30) Foreign Application Priority Data

Dec. 23, 1999 (NO) ..... 1999 6449

(51) Int. Cl.[7] ..... B63B 21/50; E21B 43/013
(52) U.S. Cl. ..... 114/230.12; 166/355
(58) Field of Search ..... 405/210, 224.2, 405/224.3, 224.4; 166/355; 114/230.12, 293, 72, 73, 74 R, 74 T, 74 A; 441/4, 5; 137/236.1

(56) References Cited

U.S. PATENT DOCUMENTS 3,590,407 A * 7/1971 Bratianu et al. ..... 114/230.12
4,436,048 A * 3/1984 Gentry et al. ..... 114/230.12
5,697,732 A * 12/1997 Sigmundstad ..... 405/169
6,003,603 A * 12/1999 Breivik et al. ..... 166/357
6,021,848 A * 2/2000 Breivik et al. ..... 166/344
6,053,787 A * 4/2000 Erstad et al. ..... 441/5
6,176,193 B1 * 1/2001 Whitby et al. ..... 114/230.12
6,193,574 B1 * 2/2001 Pollack ..... 441/4

* cited by examiner

*Primary Examiner*—Michael Safavi
(74) *Attorney, Agent, or Firm*—Sughrue Mion, PLLC

(57) ABSTRACT

A system for supplying cooling water to a process on board a floating vessel for the production of hydrocarbons, wherein the vessel (1) is anchored by means of a bottom-anchored turning unit (20) mounted in a receiving space (7) in the hull (34) of the vessel and allowing turning of the vessel (1) about the turning unit, and wherein the turning unit (20) supports a swivel unit (24) for the transfer of hydrocarbons from production risers (28) extending between the seabed and the turning unit (20), the system comprising a conduit means (30) depending from the vessel (1) to a depth for taking in cooled sea water, and a pump means (44) for pumping of the sea water from the conduit to a place of use for the process. The turning unit (20) is designed as a seawater swivel, the unit being provided with one or more passages (29) for receiving upper end portions of respective seawater risers (30) constituting the conduit means, and with a means for transferring sea water from the upper end portions of the risers (30) to an annulus (31) arranged at the boundary surface between mutually movable parts (21, 22) of the turning unit (20) or between the tuning unit (20) and the vessel hull (34), and communicating with one or more passages (41) arranged in the vessel hull and leading to said place of use, a seawater sealing means (37, 39) being arranged on each side of the annulus (31).

12 Claims, 7 Drawing Sheets

COOLING WATER SYSTEM

The invention relates to a system for supplying cooling water to a process on board a floating vessel for the production of hydrocarbons, wherein the vessel is anchored by means of a bottom-anchored tuning unit mounted in a receiving space in the hull of the vessel and allowing turning of the vessel about the turning unit, and wherein the turning unit supports a swivel unit for the transfer of hydrocarbons from production risers extending between the seabed and the turning unit, the system comprising a conduit means depending from the vessel to a depth for taking in cooled sea water, and a pump means for pumping of the sea water from the conduit to a place of use for the process.

Offshore extraction and production of hydrocarbons in many cases is carried out on board so-called FPSO vessels, i.e. vessels constructed and built for production, storage and offloading of hydrocarbons (FPSO=Floating Production, Storage and Offloading).

Such vessels are typically anchored by means of a plurality anchor lines fixed to anchors on the seabed and to a turning unit mounted in a receiving space in the hull of the vessel, and allowing the vessel to turn freely about the turning unit, under the influence of wind, waves and water currents. The turning unit may be a submerged buoy of the two-part type comprising a bottom-anchored central member and an outer buoyancy member which is rotatably mounted on the central member and is releasably fastened in the receiving space in the vessel hull. As an alternative, the turning unit may consist of a bottom-anchored turning body (turret) which is rotatably mounted in the receiving space by suitable bearing means, or is rotatably suspended from the deck or in the bow of the vessel.

As the turning unit allows the vessel to turn freely about the anchoring point, its central buoy member or turning body, which is stationary in relation to the seabed, supports a swivel unit for the transfer of process fluids etc. between the relevant risers and a pipe system on the vessel. The risers transfer oil, gas and water between the vessel and the seabed, and there is further arranged a so-called umbilical providing paths for chemicals, electric and fibre-optic signals, and electric and hydraulic power.

A process plant on board a vessel of the above-mentioned type requires supply of large quantities of cooling water. A typical FPSO vessel for oil production may use about 5000 $m^3/h$, and an LNG plant typically may require about 30000 $m^3/h$. Most FPSO vessels today utilize a cooling water intake structure which, by means of pumps, pulls up sea water to a seawater intake via freely hanging, flexible hoses or conduits extending down to a depth of maximum 40 m. As mentioned above, the vessel is anchored by means of a plurality of anchor lines fastened to the turning unit. This implies that the length of the seawater intake pipes is limited to avoid interfering collisions with the anchor lines. From the water intake the sea water is pumped further to cooling devices on the vessel. Because of the limited length of the cooling water intake pipes, the temperature of the intake water is almost the same as the surface temperature.

The efficiency of a process comprising cooling increases with increasing temperature of the cooling water. The result is a lower energy consumption and a more efficient, and therewith less expensive equipment. As known, the temperature of the sea water decreases with the water depth, so that it is generally advantageous to have the seawater intake as deeply as possible.

The object of the invention is to provide a system for the supply of cooling water for the current purpose wherein the system enables a very cost-efficient and operationally safe construction for cooling water supply, and simultaneously enables the supply of sea water with the lowest possible temperature to the cooling systems of the vessel.

The above-mentioned object is achieved with a system of the introductorily stated type which, according to the invention, is characterized in that the turning unit is designed as a seawater swivel, the unit being provided with one or more passages for receiving upper end portions of respective seawater risers constituting the conduit means, and with a means for transferring sea water from the upper end portions of the risers to an annulus arranged at the boundary surface between mutually movable parts of the turning unit or between the turning unit and the vessel hull, and communicating with one or more passages arranged in the vessel hull and leading to said place of use, a seawater sealing means being arranged on each side of the annulus.

In the system according to the invention, the cooling water pipes are located within the anchoring system and are geostationary in relation to the seabed, and thus they will not interfere with the anchoring system and the production risers when the vessel turns under the influence of wind and weather. The cooling water pipes therewith may be extended all the way down to the seabed without interfering with the anchoring system. The cooling water is not passed through the process swivel, but is passed directly through the turning unit and into the vessel by the use of simple dynamic and static seals.

The system is particularly valuable in places where the air and seawater surface temperatures are high. The lower cooling water temperature implies a number of economic and environmental advantages. As to economic advantages, there may be mentioned:

- Stable annual production quantities
- Constant cooling water temperature facilitates optimum process operation
- Increased production in relation to power consumption
- Lower maintenance costs because of lesser fouling and corrosion tendency of the cold sea water
- Lower condensation temperature for the steam turbine increases its output
- Lower design pressure for the fractionating and cooling part of the production plants
- Reduced heat transfer surface area because of less fouling and lower $\Delta T$
- A more compact process plant design which is better suited for FPSO vessels
- Lower cost for the process plant As to environmental advantages, there may be mentioned:

- Lesser $CO_2$ spill in relation to production quantity
- No chlorinating necessary
- Practically no thermal contamination The invention will be further described below in connection with a number of exemplary embodiments with reference to the drawings, wherein FIG. 1 shows a side view of a vessel which is anchored to a seabed and is provided with a cooling water supply system according to the invention;

In the drawings, corresponding parts and elements in the different drawing figures are designated by the same reference numerals.

Figure 1:
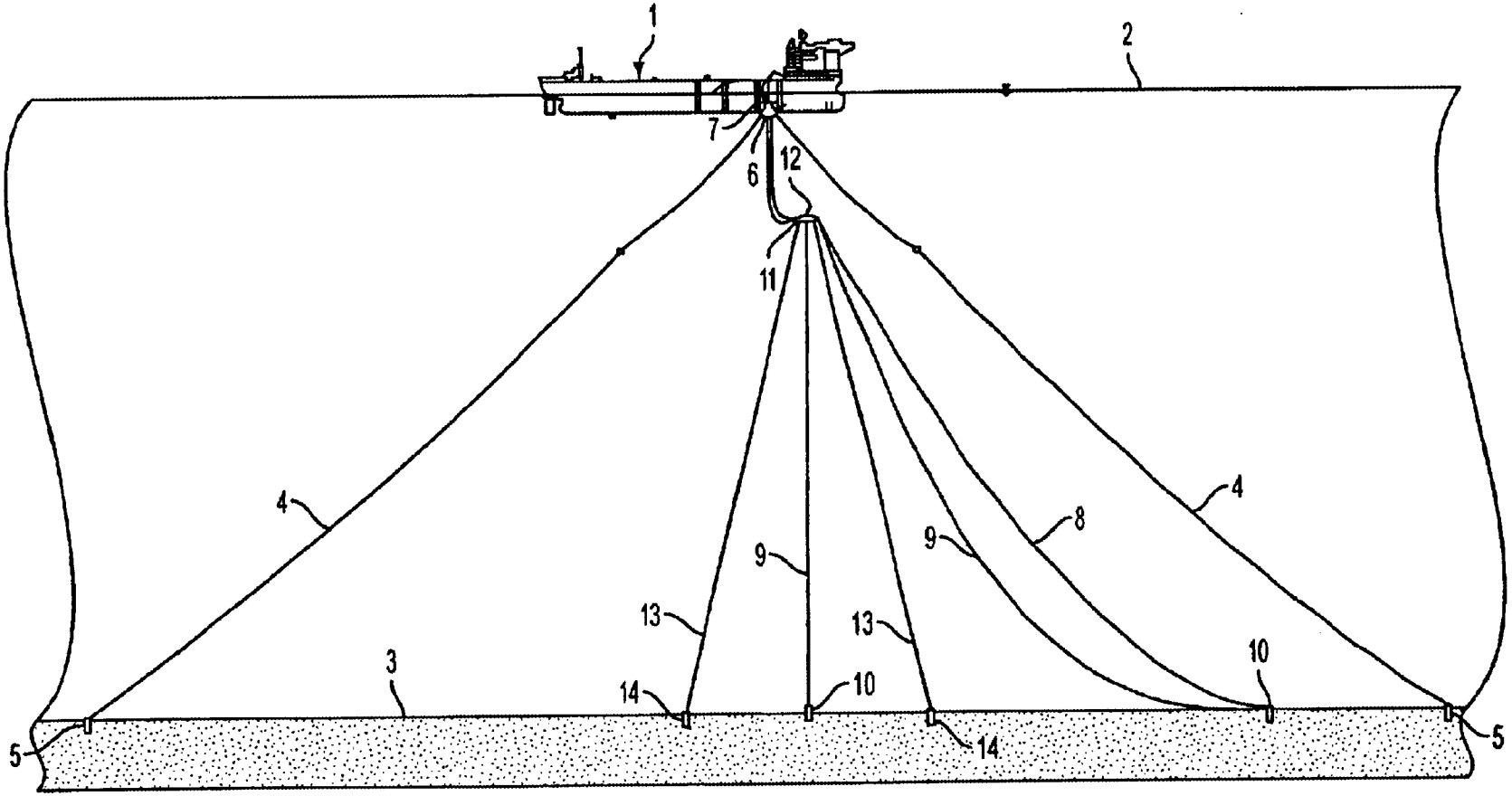

In FIG. 1 there is shown an FPSO vessel 1 floating on a water surface 2 and being anchored to a seabed 3 by means of a plurality of anchor lines 4. The anchor lines at their lower ends are connected to respective anchors 5, and at their upper ends they are connected to a turning unit 6 mounted in a submerged receiving space 7 at the bottom of the vessel. As mentioned above, the anchor lines are connected to a central buoy member or a turning body (turret) allowing the vessel to turn freely about the anchoring point. As also mentioned above, the geostationary turning body or buoy member supports a swivel unit (not shown in FIG. 1) for the transfer of, inter aria, hydrocarbons from one or more production risers 8 extending between the seabed 3 and the turning unit 6.

The system of the vessel 1 for the supply of cooling water to production processes on the vessel includes one or more seawater risers 9 which are shown to extend between the turning unit 6 and the seabed 3, and which are connected at their lower end to an anchoring means on the seabed, for instance a seawater lifting pump 10. In the illustrated embodiment, both the production risers 8 and the seawater risers 9 are shown to comprise an upper flexible part which, at its lower end, is connected to a buoyancy unit 11 for support of the risers, and a lower part extending between the buoyancy unit 11 and the seabed 3. A seawater lifting pump 12 is also shown to be arranged on the buoyancy unit 11. The buoyancy unit 11 is moored to the seabed by means of mooring lines 13 connected at their lower ends to respective anchors 14.

The seawater risers 9 generally may consist of one large or several smaller risers extending down to the seabed or to a chosen depth at which the seawater temperature is sufficiently low. As also appears from FIG. 1, the water pipes 9 between the buoyancy unit 11 and the seabed 3 may have the same course as the production risers 8, or they may extend generally vertically from the buoyancy unit to the seabed. In both cases they will be kept in position at the seabed by means of an anchoring means.

Figure 2:
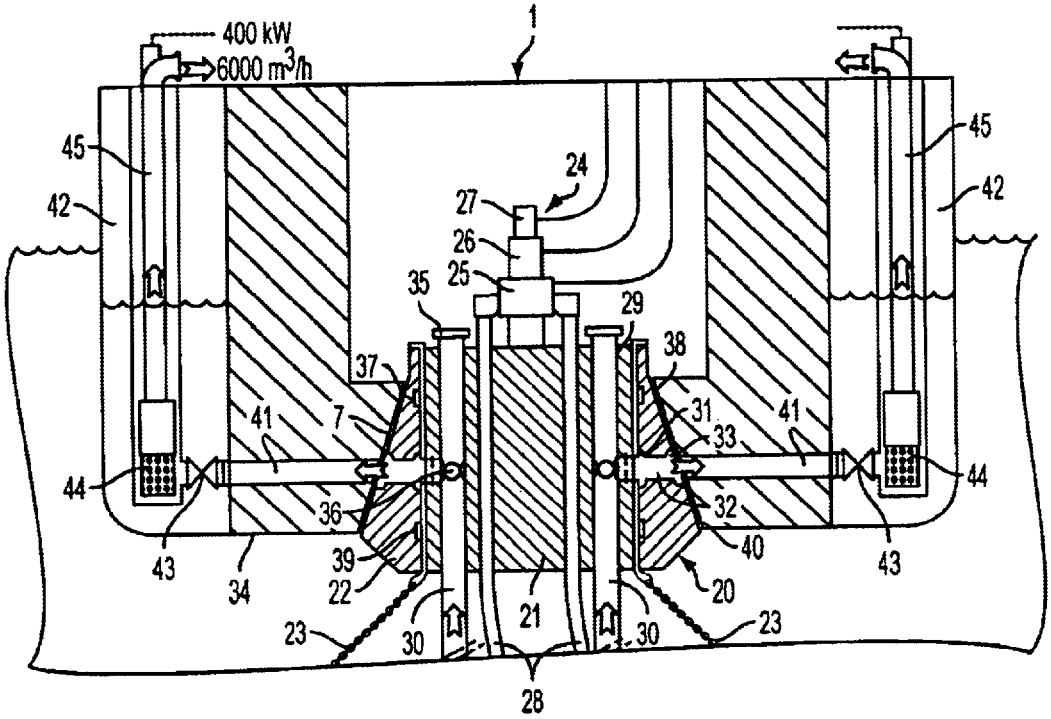
FIG. 2 shows a schematic sectional view of a first embodiment of a system according to the invention.

A first embodiment of the system according to the invention is shown in FIG. 2. The figure shows a cross-section of a vessel 1 provided at the bottom of the vessel with a receiving space 7 for the receipt of a turning unit which, in the illustrated case, is constituted by a two-part submerged buoy 20 comprising a bottom-anchored central member 21 and an outer buoyancy member 22 which is rotatably mounted on the central member. The central member is anchored by means of a suitable number of anchor lines 23. The central member supports a swivel unit 24 which, in a usual manner, may comprise a process swivel 25, a hydraulic utility swivel 26 and an electric power and control signal swivel 27. Further, the central member supports a number of process or production risers 28 extending between the process swivel 25 and the seabed (not shown).

In accordance with the invention, the turning unit or buoy 20 is designed as a seawater swivel, i.e. a swivel for transferring sea water. For this purpose the central member 21 of the buoy is provided with a number of passages 29 receiving the upper end portions or respective seawater risers 30, and with a means for the transfer of sea water from the risers to an annulus 31 arranged at the boundary surface between the central member 21 of the buoy and its outer buoyancy member 22. In the outer member of the buoy there is arranged a number of radial passages 32 communicating with an additional annulus 33 arranged at the boundary surface between the outer member 22 and the vessel hull 34.

As appears, the seawater risers 30 are closed at their upper end by means of a lid 35, and they are provided with water outlets in the form of a plurality of holes 36 communicating with the annulus 31 between the inner and outer members 21, 22 of the buoy. Outside of the outlet holes 36, the risers 30 suitably may be surrounded by respective annuluses communicating with the annulus 31 between the buoy members through a number radial passages in the inner buoy member 21.

On each side of the annuluses 31 and 33 there are arranged respective sealing means, more specifically inner sealing means 37 and 38, respectively, preventing leakage of sea water into the space above the buoy 20, and outer sealing means 39 and 40, respectively, preventing leakage of warmer surface sea water into the passages for cold water from the risers 30. As will be understood, it is here the question of dynamic sealing means 37, 39 between the mutually movable buoy members, and static sealing means 38, 40 between the outer buoy member and the vessel hull.

In the vessel hull there are arranged a number of passages 41 extending between the annulus 31 and a water intake in the vessel. In the illustrated embodiment, this water intake is constituted by a pair of wing tanks 42 arranged on respective sides of the vessel 1. The passages 41 lead into the wing tanks 42 via a respective valve 43, and are associated with a pump means 44 connected to an appurtenant conduit 45 for the supply of water in the wing tank to the relevant place of use in the production process on the vessel.

The annulus 33 between the outer buoy member 22 and the vessel hull 34 possibly might be omitted under the presupposition that the buoy 20 were provided with suitable guiding means ensuring that the buoy is introduced and secured in the receiving space with the passages 32 aligned with respective ones of the passages 41 in the vessel hull.

As mentioned in the introduction, a process plant on an FPSO vessel requires large quantities of cooling water, typically 5000 to 30000 $m^3/h$. The taking-in of such large water quantities through a swivel will require a flow area corresponding to a pipe having a diameter from ca. 500 mm up to ca. 2000 mm. Swivels for the transfer of well flows normally have a flow area corresponding to pipes having an inner diameter from 10 mm up to 400 mm. Swivels for well flows have to seal completely for well flows having a pressure of up to 300–400 bar, because any leakage of process fluid may be critical. The design of such swivels and associated sealing systems requires special materials, strict tolerances and expensive sealing systems. A possible small leakage in a swivel transferring sea water is unproblematic, and a swivel for sea water may be designed for a low pressure (typically 1–5 bar), with simple components, cheaper materials and simpler sealing solutions.

The central buoy member or turret will be subjected to high loads from the anchoring system. The turret therefore has a limited capability of accepting pressure in a seawater passage. However, installing the pumps in a sea water intake in a wing tank as shown in FIG. 1, will lower the pressure inside the turret. The turret therefore will not be Is unduly stressed in its application as a seawater swivel. Even if the pumps in some cases will have to be lowered down into the seawater risers, as described below, the pressure of the water can be kept very low. The extra stress on the turret can also be kept low.

Figure 3:
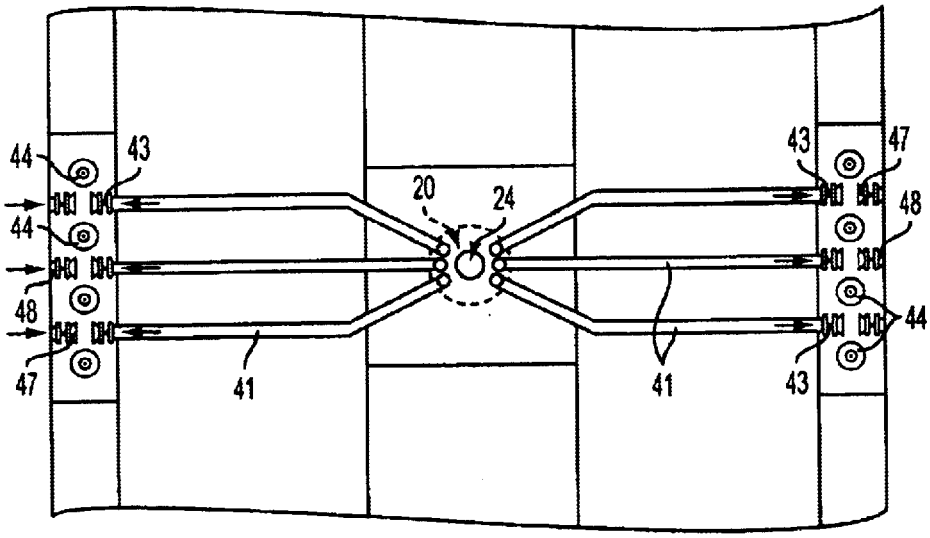
FIG. 3 shows a schematic sectional view, as viewed from above, of a part of a vessel hull with elements forming part of a system according to the invention.
Figure 4:
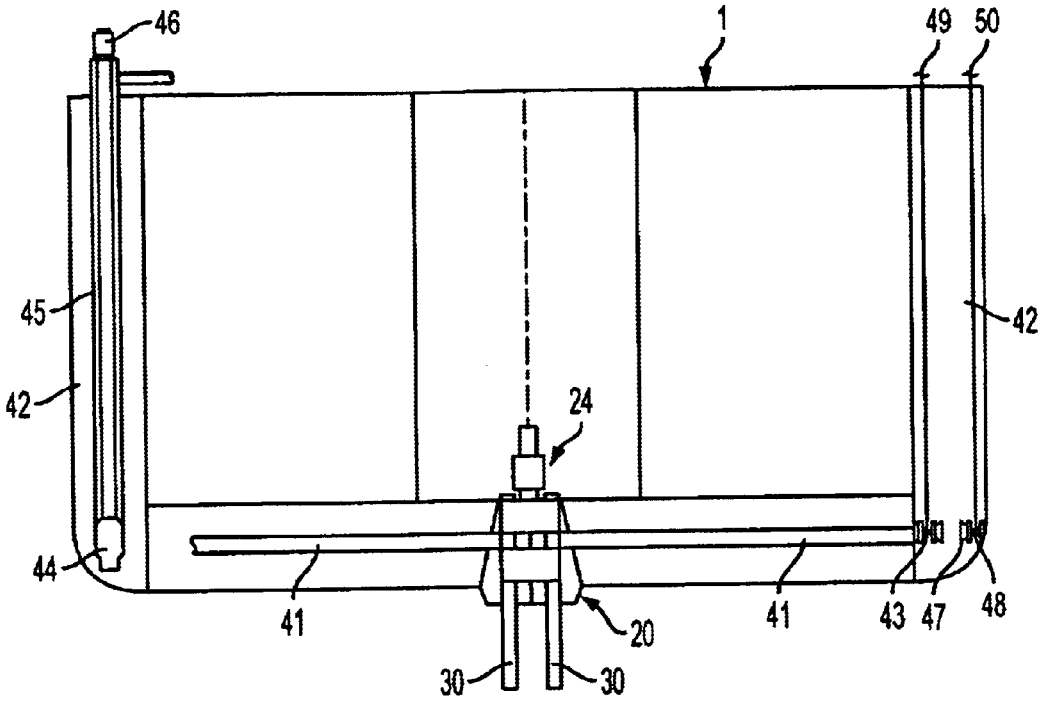
FIG. 4 shows a schematic side view of the arrangement of FIG. 3.

FIGS. 3 and 4 show a schematic plan view and a side view, respectively, of a part of the elements shown in FIG. 2. As appears from FIG. 3, the passages 41 consist of six pipes of which three pipes debouch into each of the wing tanks 42 via a respective valve 43. In each of the wing tanks there are arranged four seawater lifting pumps 44. At the top of the conduits 45, extending between the pumps and the deck of the vessel, there is arranged a unit 46 for electric power supply to the associated pump.

In each of the wing tanks 42 there is also arranged an emergency water inlet means, more specifically three emergency inlets 47 communicating with the surrounding sea via appurtenant valves 48. The valves 43 and 48 are shown to be coupled to a valve handle 49 and 50, respectively, at the deck of the vessel 1, for operation of the valves, either manually or by remote operation. The emergency inlets are used if the water passages or the inlet valves 43 should be damaged, so that the cooling water flow is limited. Water flowing into the wing tanks in case of opening of the emergency inlets, will be water from the vicinity of the surface, and thus have a higher temperature. However, the process then may still be supplied with cooling water even if it has a higher inlet temperature.

When the inlet valves 43 in the wing tanks are opened, there will be a free passage for the water from the inlet at the lower end of the seawater risers to the wing tanks. When the pumps 44 start working, the water level in the wing tanks start dropping, as suggested in FIG. 2. The difference in static height between the inside and outside of the seawater intake or wing tank pushes the water up through the risers 30, through the central buoy member (turret) and through the passages and into the wing tanks. The water level within the wing tanks will drop until there is a balance between the friction losses in the pipes and passages and the pressure created by the difference in static height of the water. To ensure that the difference in level will not be too high, the inside diameter of the seawater risers is so large that an acceptable friction loss is generated, estimated to 5–10 m of water column.

Figure 5:
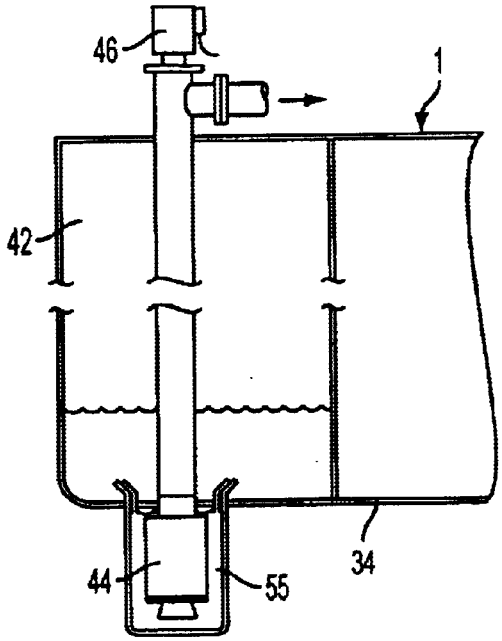
FIG. 5 shows a sectioned side view of a wing tank having a suction extension well.

If the water level inside the water intake or wing tank is too low, the pumps 44 may cavitate and be damaged. To ensure that the pumps have a sufficient pressure at the inlet of the impeller, a hole can be made in the bottom of the wing tank, and the pump can be placed in a suction extension well in the form of a container installed below the tank bottom. Such an embodiment is shown in FIG. 5 wherein a container 55 is installed in an opening in the bottom of the tank 42 and receives a pump head 44. The container and the pump head may be installed from the deck and may be lifted out as a unit if desired. A seal (not shown) is provided between the container and the vessel hull 34, to prevent "warm" surface water from leaking into the wing tank.

Figure 6:
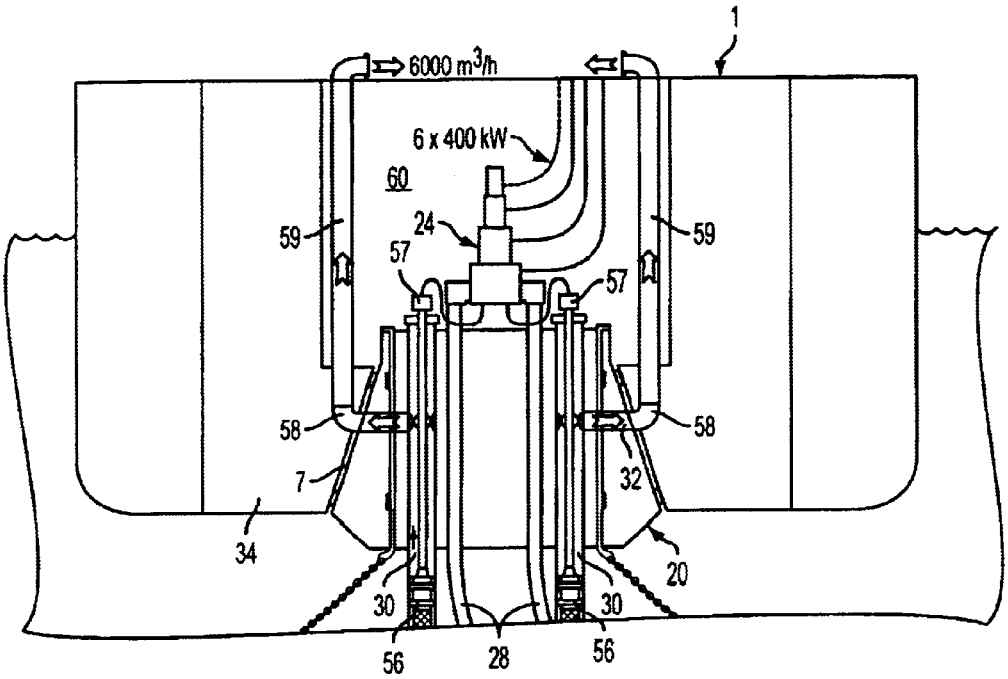
FIG. 6 shows a schematic sectional view of a second embodiment of a system according to the invention.

A second embodiment of the system according to the invention is shown in FIG. 6. The embodiment to a large extent corresponds to the embodiment of FIG. 2, but the seawater pumps here are not arranged in a water intake in the vessel. Instead a pump 56 is arranged in each of the seawater risers 30 at a location below the buoy 20. Electric power to the pumps is supplied as shown via the swivel unit 24 and coupling heads 57 at the top of the risers 30. In this embodiment, instead of the passages 41 in the vessel hull shown in FIG. 2, there are arranged a number of passages 58 which are connected to respective conduits 59 extending upwards in the space 60 above the buoy and supplying cooling water to the relevant place of use in the production process on the vessel.

Figure 7:
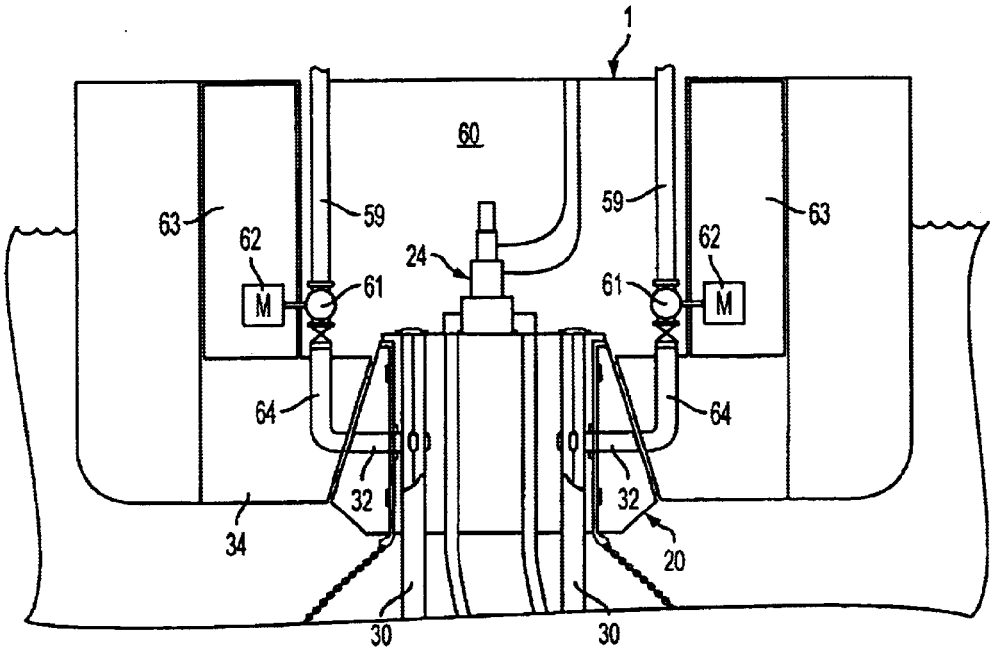
FIG. 7 shows a schematic sectional view of a third embodiment of a system according to the invention.

A third embodiment of the system according to the invention is shown in FIG. 7. Also this embodiment to a large extent corresponds to the embodiment of FIG. 2, except that the seawater pumps are not arranged in a water intake in the vessel. Instead, the relevant pumps 61 are arranged in the space 60 above the buoy 20. The pumps are driven by appurtenant motors (M) 62 arranged in a pump room 63 wherein also the pumps may be arranged. The pumps 61 are connected to passages or conduits 64 communicating with the passages 32 in the outer buoy member, possibly via an annulus (not shown), as in the embodiment according to FIG. 2.

Figure 8:
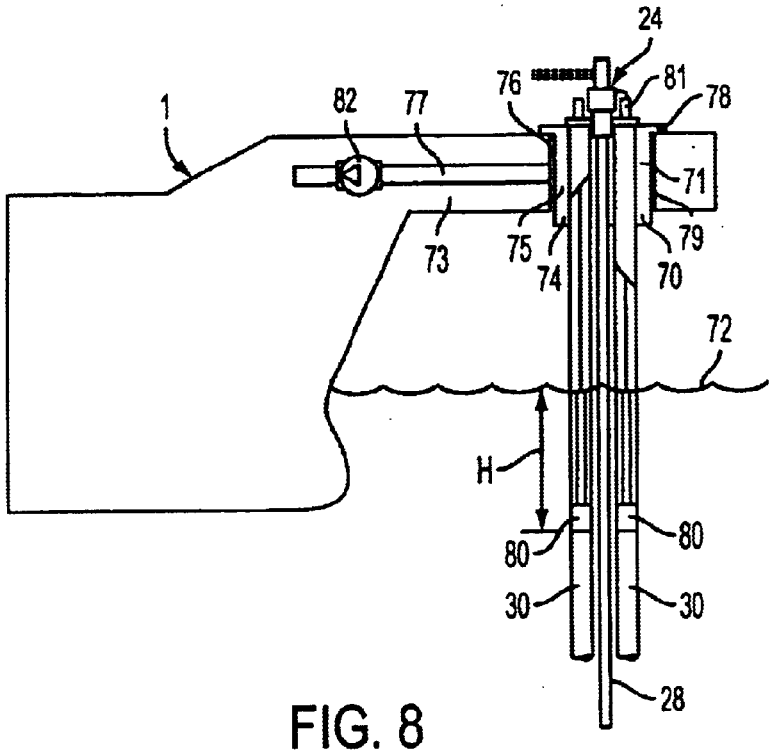
FIG. 8 shows a schematic side view, partly in section, of a fourth embodiment of a system according to the invention.

FIG. 8 shows a schematic, partly sectioned side view of a fourth embodiment of a system according to the invention. In this case the turning unit is constituted by a bottom-anchored turning body (turret) 70 mounted in a receiving space 71 arranged in a vessel 1 at a level above the water surface 72, more specifically in a hull part 73 extending forwards from the bow of the vessel 1. The turning body is rotatably mounted in relation to the receiving space, so that the vessel can turn freely about the turning body. The anchor lines for bottom-anchoring of the turning body are omitted in FIG. 8.

The turning body is provided with a number of vertical passages for receiving the upper end portions of risers 30, these portions, in a manner similar to the embodiment according to FIG. 2, being provided with a number of outlet holes 74 for sea water. The outlet holes communicate with radial passages 75 leading to an annulus 76 between the turning body and the hull part 73. A pipe connection 77 is arranged between the annulus 76 and the relevant place of use on the vessel. Dynamic seals 78 and 79 are arranged on each side of the annulus 76.

In this embodiment in which the turning body is arranged above the water surface, the water will not flow in the system without artificial lift. The seawater pumps therefore must be installed within the seawater risers 30. A pump 80 is shown to be installed in each of the risers 30 at a sufficient depth H below the water surface to produce a sufficient static pressure to ensure that the pump has suitable suction conditions. A typical distance is 10–40 m below the water surface. As the turret and pumps 80 are stationary in relation to the seabed, the power supply to the pumps must take place via the swivel unit 24 and respective junction boxes 81. In addition to the pumps 80, also a booster pump 82 is shown to be arranged in the pipe connection 77.

Figure 9:
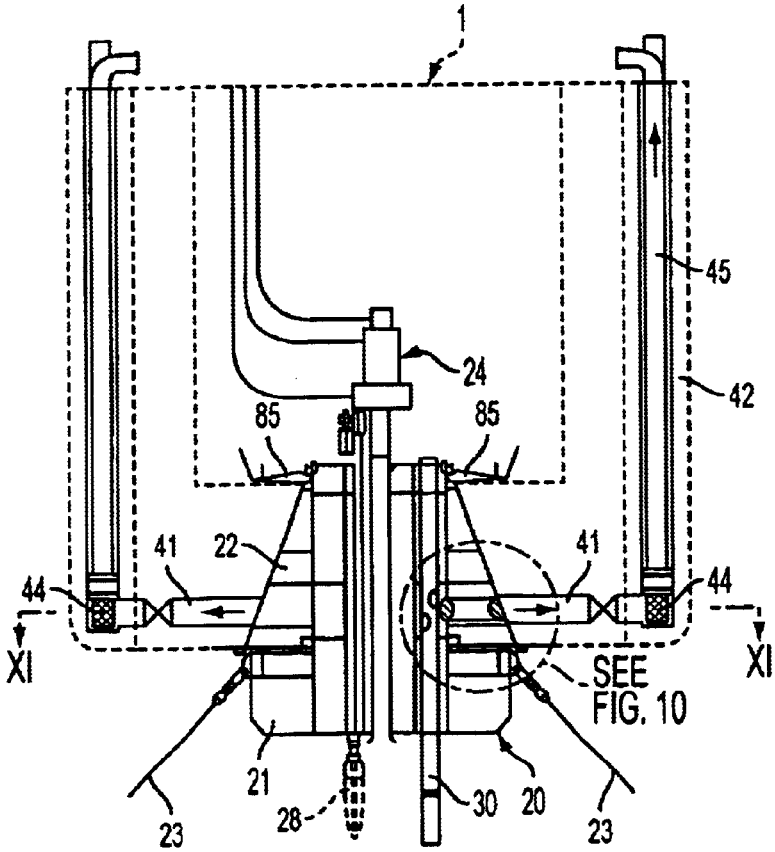
FIG. 9 shows a side view of an embodiment essentially corresponding to the embodiment according to FIG. 2.

FIG. 9 shows a sectional view of an embodiment which in all essentials corresponds to the embodiment according to FIG. 2, but wherein the Figure shows some additional details and constructional modifications, especially in connection with the buoy 20. For a description of the embodiment reference is made to the description of FIG. 2. In addition it may be remarked that the Figure also shows a locking mechanism 85 for releasable attachment of the buoy 20 in the receiving space in the vessel.

Figure 10:
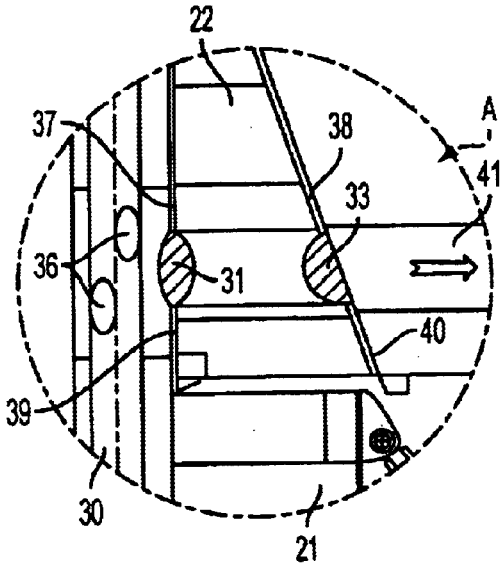
FIG. 10 shows the detail A in FIG. 9 on an enlarged scale.

FIG. 10 shows a cutout A in FIG. 9 on an enlarged scale, and shows construction-details in connection with the annuluses 31 and 33 and the sealing means 37–40.

Figure 11:
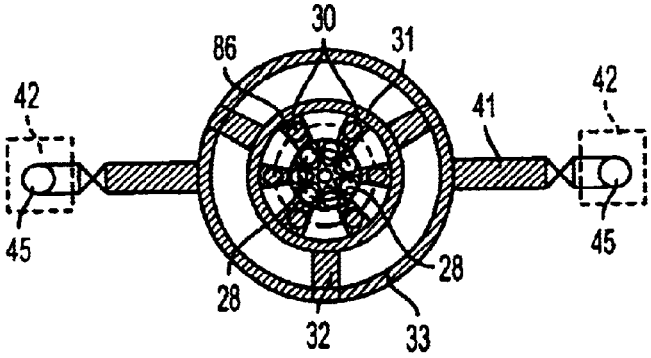
FIG. 11 shows a sectional view essentially along the line XI—XI in FIG. 9.

FIG. 11 shows a horizontal section along the line XI—XI in FIG. 9 and shows a possible arrangement of production risers 28 and seawater risers 30 in the central buoy member 21. As shown, there are arranged seven production risers 28 and six seawater risers 30 which are distributed along respective concentric circles. Each of the seawater risers 30 outside of the outlet holes 36 is partly surrounded by a passage 86 communicating with the annulus 31. The annulus 31 in turn communicates with the annulus 33 via three passages 32.

Figure 12:
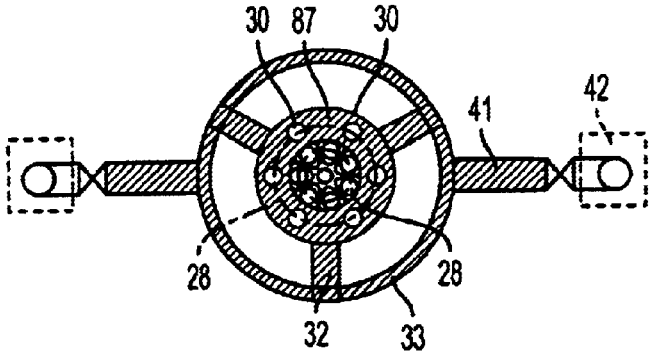
FIG. 12 shows a corresponding sectional view to that of FIG. 11, but of an alternative embodiment.

FIG. 12 shows a sectional view corresponding to that of FIG. 11, but of an alternative embodiment with respect to the connection between the riser outlets 36 and the passages 32. This embodiment is without individual passages (or annuluses) in connection with each of the seawater risers 30. Instead, the annulus 31 is radially extended to a larger annulus 87, and placed such that the outlet openings 36 of the risers debouch directly into this annulus.

Figure 13:
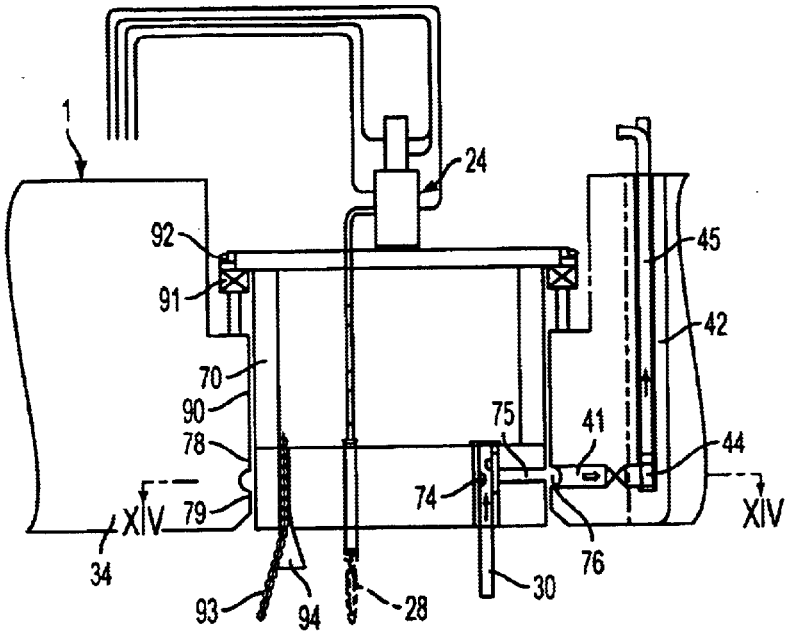
FIG. 13 shows a sectional view of a fifth embodiment of a system according to the invention.

FIG. 13 shows a sectional view of a fifth embodiment of the system according to the invention.

In a manner corresponding to FIG. 8, the turning unit here is constituted by a turning body 70 which is rotatably mounted in a receiving space in the vessel 1, but the receiving space here is in the form of a submerged well 90 arranged in the bottom of the vessel. The turning body is supported by a bearing means consisting of an axial bearing 91 and a radial bearing 92. The turning body is anchored to the seabed by means of a number of anchor lines 93 (only one is shown) introduced into the turning body via respective guide tubes 94.

In a manner corresponding to FIG. 8, the seawater risers 30 are provided with a number of outlet holes 74 communicating via a number radial passages 75 with an annulus 76 between the turning body and the vessel hull. In this embodiment, however, a number of passages 41 are arranged in the vessel hull, in a manner corresponding to the embodiments of FIGS. 2 and 9, these passages extending between the annulus 76 and a water intake in the vessel. The water intake may be constituted by a wing tank 42 in a manner corresponding to that of FIG. 2, wherein a pump 44 which is coupled to a pipeline 45, is placed at the bottom of the wing tank. A corresponding water intake or a wing tank may be arranged in the vessel on the opposite side of the well 90 in relation to what is shown in FIG. 13.

Figure 14:
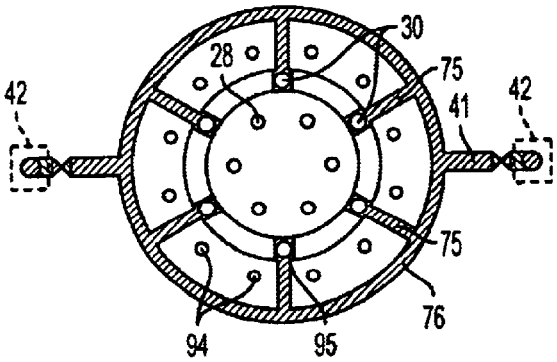
FIG. 14 shows a sectional view essentially along the line XIV—XIV in FIG. 13.

FIG. 14 shows a horizontal section along the line XIV—XIV in FIG. 13, and shows a possible arrangement of production risers 28, seawater risers 30 and anchor line fastening points in the turning body 70. As shown, six production risers 28, six seawater risers 30 and twelve guide tubes 94 for anchor lines are arranged along respective concentric circles. Each of the seawater risers 30 outside of the outlet holes 74 is surrounded by a passage or an annulus 95 communicating with the annulus 76 via an associated passage 75.

Figure 15:
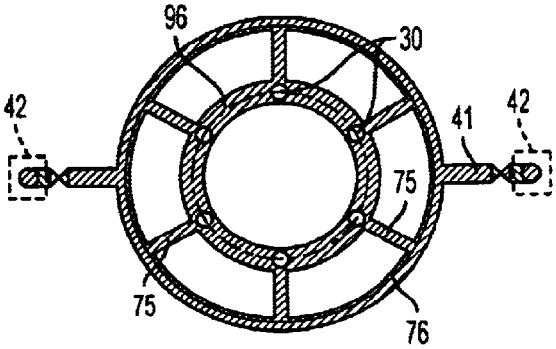
FIG. 15 shows a corresponding sectional view to that of FIG. 14, but of an alternative embodiment.

FIG. 15 shows a sectional view corresponding to that of FIG. 14, but of an alternative embodiment with respect to the connection between the riser outlets 74 and the passages 75. Instead of individual passages or annuluses 95 around the risers 30, there is arranged a common annulus 96, so that the outlet openings 74 of the risers debouch directly into this annulus.

In operation of the system according to the invention, as the water flows from the inlet of the seawater risers to the surface, there is generated a difference in pressure from the inside to the outside of the risers. This difference in pressure is caused by the friction losses and will increase from zero at the inlet to approximately the difference in pressure caused by the difference in static head between the inside and the outside of the water intake/wing tank at the buoy or turret position.

The external pressure will tend to collapse the risers, and the risers will have to be designed with a sufficient thickness or with a suitable reinforcement to prevent the risers from collapsing.

The risers will also be subjected to movements caused by the movements of the vessel. Other forces are induced by wind, waves and forces caused by water currents. Due to the large diameter of the pipes and the induced movements and forces, the risers will be expensive to manufacture. It may therefore be more economic or more technically feasible to install the pumps at a sub-sea pumping station.

The pumps may be installed at the seabed or thereabove, depending on the water depth and the optimum shape of the riser system. When the pumps are installed inside the risers or supply water into the risers at a certain depth, the internal pressure in the risers will be higher than the external water pressure above the location of the pump unit. As the riser no longer needs to be dimensioned to prevent collapse caused by the external overpressure, it can be made as a less expensive "soft" pipe. A "soft" pipe will also be less stressed by vessel movements than a rigid pipe.

What is claimed is:

1. A system for supplying cooling water to a process on board a floating vessel for the production of hydrocarbons, wherein the vessel (1) is anchored by means of a bottom-anchored turning unit (20) mounted in a receiving space (7) in the hull (34) of the vessel and allowing turning of the vessel (1) about the turning unit, and wherein the turning unit (20) supports a swivel unit (24) for the transfer of hydrocarbons from production risers (28) extending between the seabed and the turning unit (20), the system comprising a conduit means (30) depending from the vessel (1) to a depth for taking in cooled sea water, and a pump means (44) for pumping of the sea water from the conduit to a place of use for the process, characterized in that the turning unit (20) is designed as a seawater swivel, the unit being provided with one or more passages (29) for receiving upper end portions of respective seawater risers (30) constituting the conduit means, and with a means for transferring sea water from the upper end portions of the risers (30) to an annulus (31) arranged at the boundary surface between mutually movable parts (21, 22) of the turning unit (20) or between the turning unit (20) and the vessel hull (34), and communicating with one or more passages (41) arranged in the vessel hull and leading to said place of use, a seawater sealing means (37, 39) being arranged on each side of the annulus (31).

2. A system according to claim 1, wherein the turning unit is a two-part underwater buoy (20) comprising a bottom-anchored central member (21) and an outer buoyancy member (22) rotatably mounted on the central member, and wherein the receiving space (7) for the turning unit is arranged at the bottom of the vessel (1), characterized in that the passages for the risers (30) are arranged in the central member (21) of the buoy, and that the means for transferring sea water from the upper end portions of the risers (30) comprises said annulus (31) arranged between the central member (21) and the outer buoyancy member (22) of the buoy (20), and a number of radial passages (32) arranged in the buoyancy member between this annulus and an additional annulus (33) at the boundary surface between the turning unit (20) and the vessel hull (34).

3. A system according to claim 1, wherein the turning unit is constituted by a turret (70) and the receiving space (90) for the turret (70) is arranged at the bottom of the vessel (1), characterized in that the means for transferring sea water from the upper end portions of the risers (30) comprises a number of radial passages (75) arranged in the turret (70) and communicating with said annulus (76) at the boundary surface between the turret (70) and the vessel hull.

4. A system according to claim 1, characterized in that said passages (41) in the vessel hull debouch into a water intake (42) constituted by a wing tank on each side of the vessel (1).

5. A system according to claim 4, characterized in that said pump means comprises one or more pumps (44) arranged at the bottom of each of the wing tanks (42) and which are connected to a respective conduit (45) for supplying water in the wing tank (42) to said place of use.

6. A system according to claim 5, characterized in that each of the pumps (44) is arranged in a suction extension well (55) arranged at a level below the bottom of the wing tanks (42).

7. A system according to claim 1, characterized in that the pump means comprises a number of pumps (56) arranged in respective ones of the sea water risers (30) at a location below the turning unit (20).

8. A system according to claim 1, characterized in that the pump means comprises a number of pumps (61) arranged in a dry space (60) above the turning unit (20), each of the pumps (61) being connected to a respective one of said passages (64) in the vessel hull (34) and to a respective conduit (59) for supplying sea water from the risers (30) to said place of use.

9. A system according to claim 1, wherein the turning unit is constituted by a turret (70) and the receiving space (71) is arranged at a level above the water surface (72), characterized in that the pump means comprises a number of pumps (80) arranged in respective ones of the seawater risers (30) at a chosen level below the water surface (72).

10. A system according to one claim 1, characterized in that the seawater risers (9) extend between the turning unit (6) and the seabed (3) and with their lower end are connected to an anchoring means (10) on the seabed.

11. A system according to claim 9, characterized in that the seawater risers (9) as well as the production risers (8) comprise an upper flexible part which, at its lower end, is connected to a submerged buoyancy unit (11), and a lower part extending between the buoyancy unit (11) and the seabed (3).

12. A system according to claim 8, characterized in that the pump means is constituted by a pump station located on the seabed.

* * * * *